US005869809A

United States Patent [19]

Moser

[11] Patent Number: 5,869,809

[45] Date of Patent: Feb. 9, 1999

[54] NON-DROOPING NFFR FUSER

[75] Inventor: Rabin Moser, Victor, N.Y.

[73] Assignee: Xerox Corporation, Stamford, Conn.

[21] Appl. No.: 940,602

[22] Filed: Sep. 30, 1997

[51] Int. Cl.[6] ..... G03G 15/20

[52] U.S. Cl. ..... 219/216; 399/69; 399/70

[58] Field of Search ..... 219/216, 469–471; 399/68–70, 329–334; 432/60, 228; 492/46; 118/60

[56] References Cited

U.S. PATENT DOCUMENTS

| | | | |
|---|---|---|---|
| 4,197,445 | 4/1980 | Moser | 219/216 |
| 4,219,327 | 8/1980 | Idstein | 432/60 |
| 4,549,803 | 10/1985 | Ohno et al. | 219/216 |
| 4,567,349 | 1/1986 | Henry et al. | 219/216 |
| 4,653,396 | 3/1987 | Wennerberg | 492/46 |
| 5,053,828 | 10/1991 | Ndebi et al. | 219/216 |

FOREIGN PATENT DOCUMENTS

| | | |
|---|---|---|
| 62-157073 | 7/1987 | Japan . |
| 2-008878 | 1/1990 | Japan . |
| 4-346384 | 12/1992 | Japan . |

*Primary Examiner*—Teresa Walberg
*Assistant Examiner*—J. Pelham

[57] ABSTRACT

A NFFR is disclosed which does not exhibit the phenomena of droop which can occur when the fuser switches from a standby to a run mode of operation. The elimination of droop is effected using an external heat source which together with an internal source of heat supplies heat to the surface of the heated fuser member to maintain its surface temperature at a preset standby value until such time as the fuser roll core reaches a temperature level sufficient to maintain the heated fuser member surface at a substantially constant temperature during standby and run modes of operation.

7 Claims, 3 Drawing Sheets

NON-DROOPING NFFR FUSER

BACKGROUND OF THE INVENTION

This invention relates generally to a heat and pressure, color fuser for an electrophotographic printing machine, and more particularly the invention is directed to a droop compensated fuser.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material become tacky and coalesce. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser (NFFR), the heated fuser roll is provided with a layer or layers that are deformable by a harder pressure roll when the two rolls are pressure engaged. The length of the nip determines the dwell time or time that the toner particles remain in contact with the surface of the heated roll.

The heated fuser roll is usually the roll that contacts the toner images on a substrate such as plain paper. In any event, the roll contacting the toner images is usually provided with an abhesive (low surface energy) material for preventing toner offset to the fuser member. Three materials which are commonly used for such purposes are PFA, Viton™ and silicone rubber.

All NFFR fusers, as practiced by the industry, exhibit droop when the thermal load increases. The phenomena of droop occurs when a Nip Forming Fuser Roll (NFFR) switches from the standby mode of operation to the run mode.

Due to thermal inertia of the fuser roll core, an internal lamp cannot prevent droop. In monochromatic (i.e. one color images only) fusers where droop takes place, the effect on copy quality is not visible or noticeable to the customer.

In fusing color images, the fuser roll temperature affects the appearance of the copy. Thus, the gloss and colors of color images can be adversely affected by droop. Therefore, it is important that all fusing be done at a substantially constant fuser roll temperature.

The object of this invention is to provide a NFFR color fuser wherein the phenomena of droop is minimized.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,567,349 granted to Henry et al on Jan. 28, 1986 discloses a heat and pressure fuser apparatus for fixing toner images to a substrate. The apparatus is characterized by the fact that silicone oil release agent material which is usually required for such devices is unnecessary. The fuser member which contacts the toner images comprises an outer layer of solid abhesive material capable of retaining this property without degradation over the operating life of the apparatus. The fuser member is so constructed that the abhesive coating contributes to the formation of the nip created between the fuser member and a backup roller.

U.S. Pat. No. 4,197,445 granted to Rabin Moser on Apr. 8, 1980 discloses a heat and pressure roll fusing apparatus for fixing toner images to copy substrates, the toner comprising thermoplastic resin. The apparatus includes a heated fuser roll cooperating with a backup or pressure roll to form a nip through which the copy substrates pass at relatively high (i.e. 12–20 in./sec) speeds with the images contacting the heated roll. The heated fuser roll is characterized by a relatively thick (i.e. 10 mils or greater) outer layer or surface which by way of example is fabricated from a highly insulative material such as silicone rubber or Viton to which a low viscosity polymeric release fluid is applied. Elevating the temperature of the heated roll during a standby or warm-up is accomplished by an internally disposed heating element and the operating temperature thereof during the run mode of operation is effected by an external heater.

BRIEF SUMMARY OF THE INVENTION

According to the intents and purposes of the present invention, there is provided a NFFR structure for fusing color images without exhibiting the phenomena of droop. In prior art devices, this phenomena takes place when a NFFR switches from the standby mode of operation to the run mode The minimization of droop is effected by the provision of a radiant heat. source that is used only during a period of time when droop would normally occur in high volume printers. Its power level is controlled in accordance with the operation of a heat source internal to the heated fuser member. As the core temperature increases, the heat requirement for the external heat lamp is diminished and when the proper core temperature is reached the surface temperature thereof is maintained by the internal heat source or lamp and the power to the external heat source is turned off. The fuser of the present invention assures that the standby temperature is maintained during the run mode of operation.

DESCRIPTION OF THE PREFERRED EMBODIMENT(S) OF THE INVENTION

Figure 1:
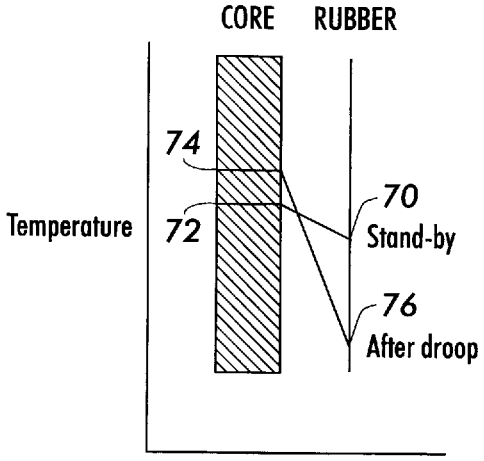
FIG. 1 Prior Art
FIG. 1 is a plot of temperature versus time depicting the phenomena of droop exhibited by a prior art fuser

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Figure 5:
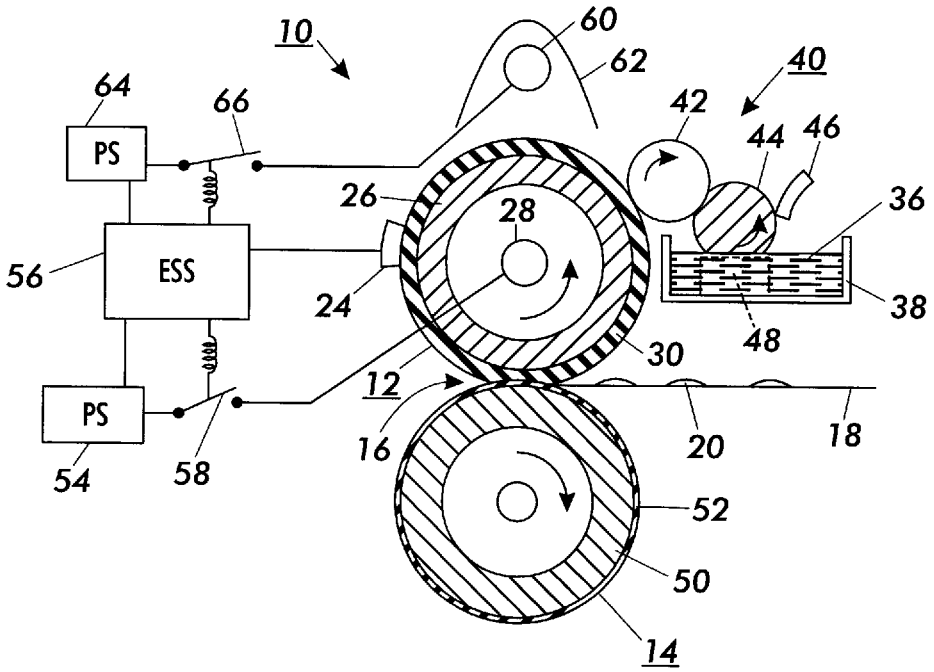
FIG. 5 is a schematic illustration of a heat and pressure roll fuser incorporating the invention.

FIG. 5 discloses a multilayered Nip Forming Fuser Roll (NFFR) fuser structure generally indicated by reference character 10. The fuser apparatus comprises a heated roll structure 12 cooperating with a non-heated backup or pressure roll structure 14 to form a nip 16 through which a copy substrate 18 passes with toner images 20 formed thereon in a well known manner. Toner images 20 carried by a final substrate 18 contact the heated roll structure while a force is applied between the roll structures in a well known manner to create pressure therebetween resulting in the deformation of the heated fuser roll structure by the nonheated pressure roll structure to thereby form the nip 16.

As a substrate 18 passes out of the nip 16, it generally self strips except for very light weight ones. These substrates are led away from the fuser nip via a paper guide, not shown. After separating from the fuser roll, substrates are free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry maintains the surface temperature to a predetermined value, for example, on the order of 375°–400° F. The heated roll structure 12 comprises a rigid core or hollow cylinder 26 having a radiant quartz heater 28 disposed in the hollow thereof. A deformable outer layer 30 may comprise Viton™ or silicone rubber which is adhered to the core 26 in a well known manner. The outer layer may have a thickness in the order of 10–150 mils.

Because the outer layer 30 is not adequately abhesive, it has been found desirable to coat this layer with a release agent material 36 contained in a sump 38. The material 36 comprises a polymeric release agent material such as silicone, mercapto or aminosilicone oil.

For the purpose of coating the heated roll structure 12 there is provided a Release Agent Management (RAM) system generally indicated by reference character 40. The mechanism 40 comprises a donor roll 42, metering roll 44, doctor blade 46 and a wick 48. The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a nickel or chrome plated steel roll having a 4–32 AA finish. The metering roll has an outside diameter of 1.0 inch. As mentioned above, the metering roll is supported for rotation, such rotation being derived by means of the positively driven heated roll structure 12 via the rotatably supported donor roll 42.

Wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

The doctor blade 46 preferably fabricated from Viton is ¾×⅛ in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy. The donor roll 42 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer (not shown) of the donor roll preferably comprises overcoated silicone rubber. However, other materials may also be employed.

The backup or pressure roll structure 14 comprises a relatively thick, rigid metal core 50 to which is adhered a relatively thin, elastomeric layer 52 of, for example, silicone rubber. The layer 52 may be overcoated with a thin layer of PFA (PerFluoroAlkoxy resin). Due to the construction of the pressure roll it deforms the deformable layer 30 of the heated roll structure when the required pressure is applied therebetween, the pressure being a function of the desired deformation which corresponds to the desired length of the nip 16.

In accordance with the invention, the heater element 28 serves to elevate the temperature of the roll structure 12 using a power supply 54. The operation of the power supply 54 at a constant input to the heater element is controlled using a controller 56, a solenoid actuated switch 58 and the temperature sensor 24.

An external heat source including a lamp 60 and a reflector 62 positioned adjacent the deformable outer surface 30 is provided for radiating thermal energy thereto according to the intents and purposes of the present invention. Variable power is supplied to the lamp 60 via a power supply 64 and a solenoid actuated switch 66. Operation of the power supply 64 is controlled using the controller 56 and the temperature sensor 24.

The data acquisition, data storage, and computation, based upon temperature sensor readings and machine operations that are involved in this invention, are well within the capabilities of present and future microprocessor-based machine controllers.

When the quartz heater 28 is energized via the power supply 54 and the solenoid actuated switch 58, this heating element radiates heat to the rigid core 26 which is then conducted to the outer surface of an outer deformable layer 30 adhered to the rigid core 26.

Figure 2:
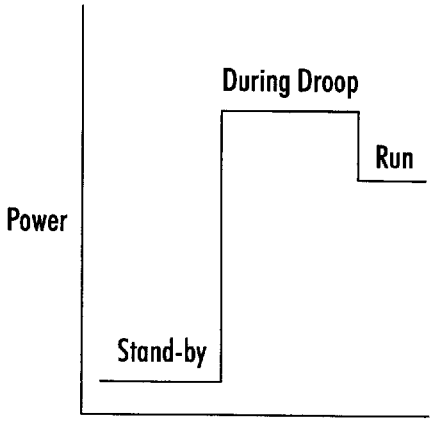
FIG. 2 Prior Art
FIG. 2 is a plot of power versus time exhibiting the phenomena of droop exhibited by a prior art fuser

In operation of a prior art NFFR fuser, the heating element 28 maintains the fuser roll surface at a standby temperature of about 385° F. indicated by reference character 72 in FIG. 1. During standby, the temperature of the core is represented by reference character 70. During a run mode, the core temperature rises to a value indicated by reference character 74. However, this rise is not fast enough to maintain the surface temperature of the layer at the required fusing temperature. The temperature of the outer layer's surface drops significantly to about 335 OF as indicated by reference character 76. This drop in temperature represents the droop that occurs in prior art fusers. The power input versus time to such a fuser as just described is illustrated in FIG. 2.

Figure 3:
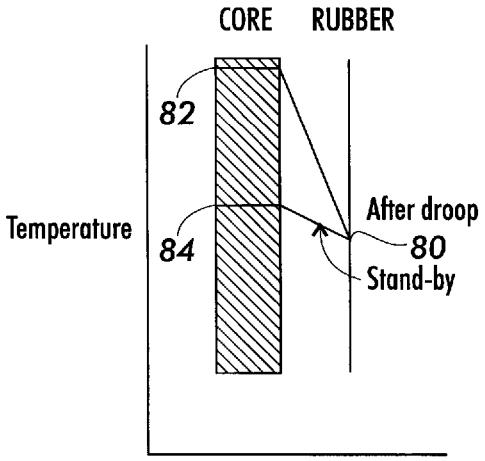
FIG. 3 is plot of temperature versus time depicting the effects of the present invention in preventing the phenomena of droop.
Figure 4:
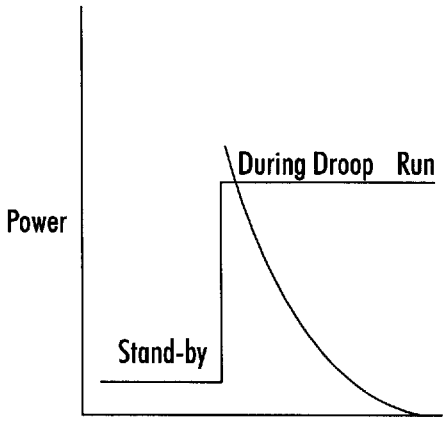
FIG. 4 is a plot of power versus time illustrating a constant power being applied to one of two heating elements and the variable power of the other of the two heating elements.

In accordance with the invention, droop is minimized by the use of the external heat source 60 in conjunction with the internal heating element in such a manner that the surface temperature remains at substantially the standby temperature of 385° F. Its power input, unlike that of the heating element 28, is not constant. On the contrary, the power supplied to the source 60 is for the sole purpose of maintaining the surface temperature of the layer 30 at the desired fusing temperature. It is only necessary to supply heat using the lamp 60 until such time as the core temperature is at a level such that the surface temperature can be maintained at the run value solely by the use of the internal heat source. As can be seen in FIG. 3, the surface temperature of the layer 30 is the same during standby and run modes of operation as indicated by reference character 80. As can be further seen from FIG. 3, the core temperature designated at 82 is substantially higher than the core temperature designated at 84 due to the cooperative operation of the two heat sources. With reference to FIG. 4, it can be seen that the power supplied by the heating element 28 is constant once it reaches its setpoint while the power supplied to the lamp 60 decreases to zero when the core temperature reaches a value at which the fuser roll surface can be maintained at the desired temperature through the use of only the internal heater.

What is claimed:

1. A NFFR structure for fusing color toner images to a substrate, said NFFR structure comprising:

a core member;

a deformable outer layer adhered to said core member;

a first heat source disposed internally of said core;

a second head source disposed externally of said core and adjacent said deformable outer layer; and a control for operating said first heat source at a constant power level and said second heat source heat source at a decreasing power level for maintaining a surface temperature of said deformable outer layer at substantially constant value during run and standby modes of operation, said operating control increasing the power to the first heat source when a run mode is initiated and concurrently energizing said second heat source, so that the surface temperature of said deformable outer layer remains substantially the same as during the standby mode.

2. Structure according to claim 1 wherein said control for operating said second heat source comprises means for inputting decreasing power to said second heat source; and wherein the power supplied to said second source of heat is terminated when the temperature of said core member is at a value sufficient to maintain said deformable outer layer at said substantially constant value.

3. Structure according to claim 2 wherein said core comprises a rigid structure.

4. A method of minimizing droop in a NFFR, including the steps of:

rotating a pair of pressure engaged fuser members such that a substrate carrying toner images is moved there between;

heating a surface of one of said members using an internal source of thermal energy;

heating said one of said members using an external source of thermal energy;

supplying power to said internal source of thermal energy at a substantially constant first level during a standby mode and at a substantially constant second level during a run operating mode of operation; and supplying power to said external source of thermal energy at a decreasing power level during said run mode of operation whereby the surface temperature of said one of said members remains substantially constant during said standby and run modes of operation.

5. The method according to claim 4 wherein said control for operating said second heat source at a decreasing power level is effected by inputting decreasing power to said second heat source.

6. The method according to claim 5 wherein said step of supplying decreasing power to said external source is effected until the temperature of said core member is at a value sufficient to maintain deformable outer layer on said core member at said substantially constant value and then terminating the supplying decreasing power to said external source.

7. The method according to claim 8 wherein said core comprises a rigid roll structure.

* * * * *